US005168620A

United States Patent [19]

Denney et al.

[11] Patent Number: 5,168,620

[45] Date of Patent: Dec. 8, 1992

[54] SHUNT ATTACHMENT AND METHOD FOR INTERFACING CURRENT COLLECTION SYSTEMS

[75] Inventors: Paul E. Denney, State College, Pa.; Natraj C. Iyer, Columbia, S.C.; William F. Hannan, III, Monroeville Boro, Pa.

[73] Assignee: Westinghouse Electric Corp., Pittsburgh, Pa.

[21] Appl. No.: 614,796

[22] Filed: Nov. 15, 1990

[51] Int. Cl.[5] ..... H01R 43/04

[52] U.S. Cl. ..... 29/597; 29/598; 310/42; 310/248

[58] Field of Search ..... 29/597, 598; 310/71, 310/42, 248, 251-253

[56] References Cited

U.S. PATENT DOCUMENTS 4,336,649 6/1982 Glaser .
4,339,874 7/1982 McCarty et al. .
4,602,179 7/1986 Kuxnetsov et al. .
4,710,665 12/1987 Kilgore et al. .
4,710,666 12/1987 Rindal et al. .

*Primary Examiner*—Carl E. Hall
*Attorney, Agent, or Firm*—T. H. Martin

[57] ABSTRACT

A composite brush to shunt attachment wherein a volatile component of a composite but mostly metallic brush, used for current collection purposes, does not upon welding or brazing, adversely affect the formation of the interfacial bond with a conductive shunt which carries the current from the zone of the brush. The brush to shunt attachment for a brush material of copper-graphite composite and a shunt of copper, or substituting silver for copper as an alternative, is made through a hot isostatic pressing (HIP). The HIP process includes applying high pressure and temperature simultaneously at the brush to shunt interface, after it has been isolated or canned in a metal casing in which the air adjacent to the interface has been evacuated and the interfacial area has been sealed before the application of pressure and temperature.

11 Claims, 5 Drawing Sheets

SHUNT ATTACHMENT AND METHOD FOR INTERFACING CURRENT COLLECTION SYSTEMS

STATEMENT OF GOVERNMENT INTEREST

The United States Government has rights in this invention pursuant to Contract No. DE-AC03-86SF16518 between Westinghouse Electric Company and the Department of Energy.

BACKGROUND OF THE INVENTION

This invention relates in general to current collection systems for high power dynamoelectric machines, and more particularly, to brush to shunt attachments for current collection systems. The invention is particularly applicable to homopolar generators and particularly to those of the advanced kind having very high power and continuous duty over the lifetime of the generator.

Brush to shunt attachments have heretofore comprised a composite brush, such as copper with a small percent by weight of graphite and other volatile components. This is conductively interfaced through either a resiliently loaded conductive interface, or alternatively, with the individual brushes each in a bonded interface with a non-composite metallic shunt such as a copper conductor which conducts the current to a load circuit.

The spring loaded brush to shunt is used in a brush box approach represented by FIG. 4, in U.S. Pat. No. 4,710,665, entitled "Homopolar Dynamoelectric Machine With Self-Compensating Current Collector" which is assigned to the same assignee as the present invention. One of the problems with this type of brush to shunt interface is that the spring contact fingers of the shunt have a relatively high contact resistance, and also that this problem is aggravated by the less than permanent spring constant and other aging effects which are not preventable. The above-mentioned patented approach describes a pulse duty type current generation system. Another type is a propulsion type or continuous duty current generation system.

Heretofore, the typical joined brush to shunt attachments were made by tamping, riveting, or soldering since the graphite and other volatile components of a composite brush do not lend themselves to effective welding or brazing. One of the principal problems with welding is that the volatile components of the brush, during these attachments, are driven off by the elevated temperatures at which the bonding process for the brush to shunt interface occurs. Another problem is that this driving off effect precludes the wetting of the brush and shunt materials. The volatilized components degrade the conductivity and contribute to a high resistivity in the interface of the brush to shunt attachment. The high resistivity in the interface results in a high temperature rise in the brush during operation which severely limits the performance of the brush. Therefore, the brush becomes inadequate to meet the demands of continuous duty, high powered homopolar power supplies.

Another problem is that the brush to shunt interface is normally weakened by the formation of voids or cracks which are initiated by the interfacial melting temperature layers presented during the process of brazing or soldering. The shrinkage stresses combined with the initiation of voids or cracks, promotes delamination of the joint during service conditions which demand a low and stable temperature rise in the brush so as not to limit the performance requirements for a high continuous duty.

Likewise tamping or riveting of the brush to shunt joint does not provide adequate strength to withstand cyclic contact and withdrawal from the current collection zone which represents a normal mode of positional change. This degrades the mechanical joint of the brush to shunt attachment resulting in a weakened interface and a corresponding deterioration in current collecting performance. A performance criterion which the prior art brush to shunt attachments do not fully satisfy is to avoid the limitations on generator performance which is imposed by the brush to shunt attachment zone rather than the more basic limitations imposed by the current collection zone in the primary interface with the spinning rotor.

SUMMARY OF THE INVENTION

In accordance with the present invention, a composite brush to shunt attachment and method for interfacing current collection systems, where a superior metallurgical interface bond is formed by a hot isostatic press, without modifying the composition of the brush material and without volatilizing the volatile components of the brush material.

According to another aspect of the invention, a method of fabricating a composite brush to shunt attachment includes providing a brush consisting of a metal composite material having one or more volatile components which are normally volatile at the bonding temperature range relating to brush to shunt fabrication, and providing a shunt of substantially non-composite metal for bonding to the metal composite brush by hot isostatic pressing (HIP). HIP includes applying high pressure and temperature simultaneously at the brush to shunt interface in order to provide substantially reduced electrical resistivity and enhanced mechanical strength in the interface of the bonded brush to shunt attachment.

Further in accordance with the method of the invention, the HIP processing of the brush to shunt interface includes isolating or canning one or more brush to shunt interface in a metal envelope or casing which may include a batch process for controlling the environment around the interface during the attachment, and evacuating or outgassing the air adjacent to the interface, and then sealing the interfacial area before applying the high pressure and temperature.

A conductive shunt substantially of non-composite metal is bonded by a hot isostatic pressing (HIP) to a metal composite brush having a minority volatile component, which is otherwise not affected in the brush to shunt interface in regard to electrical resistivity and mechanical strength for the bonding temperature range in use.

In accordance with a more limited aspect of the invention in a current transfer apparatus for a dynamoelectric machine, with a rotor coacting with the current transfer apparatus for making electrical contact through a current collecting zone on the surface of the rotor, a metal composite brush material having a volatile minority component such as graphite and a conductive shunt of substantially non-composite metal bonded to the metal composite brush by the hot isostatic pressing, substantially to enhance the electrical and mechanical performance characteristics of the brush in order to meet continuous operational duty, lifetime requirements of the generator.

Further in accordance with the invention, the hot isostatic pressure bonding of the shunt metal, of like kind to the metal composite brush, having a minority weight of graphite content, subjects the brush to shunt attachment to in-situ vacuum isolation within a surrounding metal can having a high pressure environment applied to the interface within and a high temperature cycle followed by a controlled rate and period of time for cooling.

BRIEF DESCRIPTION OF THE DRAWINGS

The invention may be better understood, and further advantages and uses thereof more readily apparent, when considered in view of the following detailed description of exemplary embodiments taken with the accompanying drawings in which.

DETAILED DESCRIPTION OF THE PREFERRED EMBODIMENTS

Figure 1:
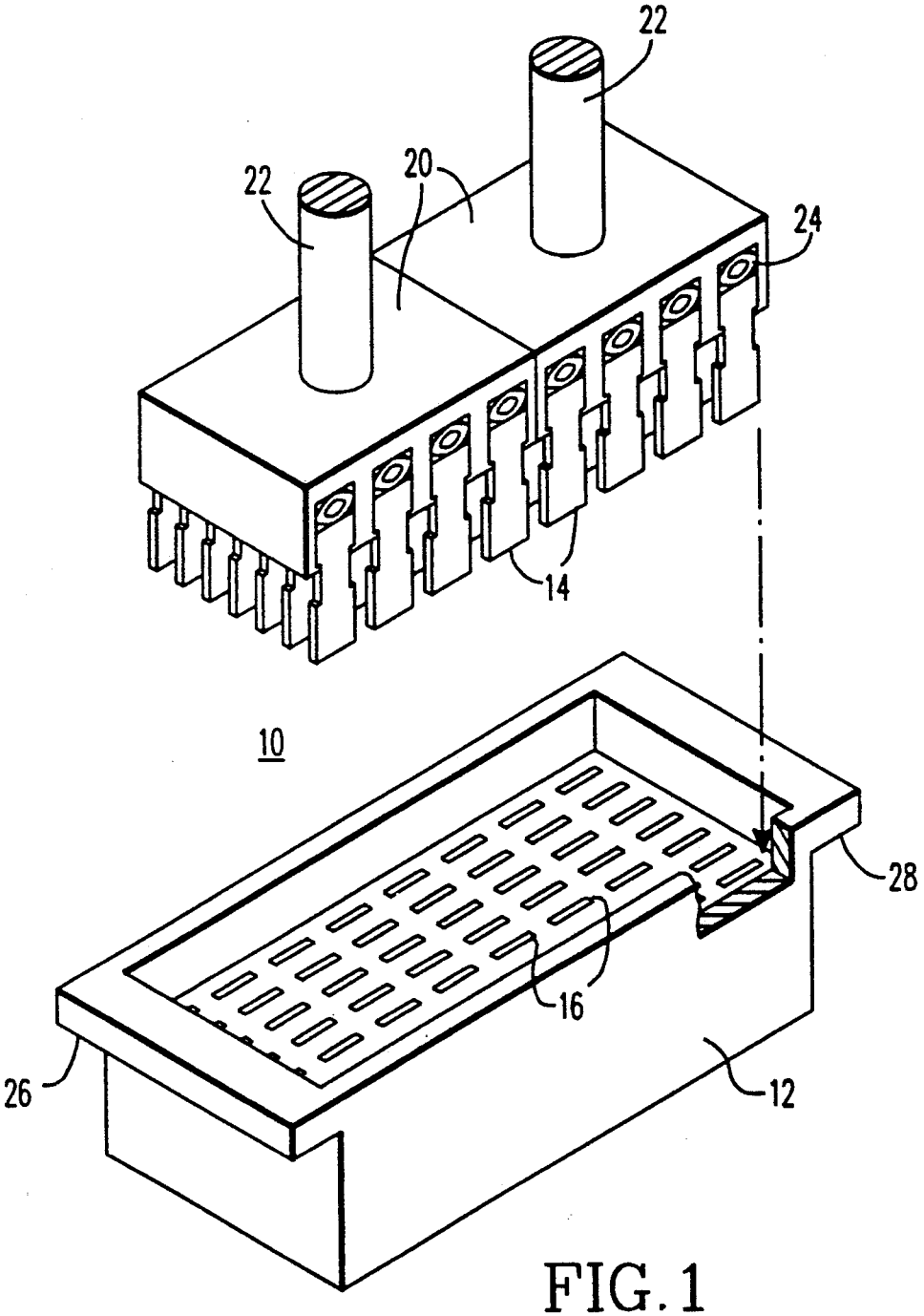
FIG. 1 PRIOR ART
FIG. 1 is a prior art showing in an isometric view of a current collecting brush assembly which is piston driven into a cylindrical type brush box, with spring finger brush to shunt contact inside the box, which is used in a pulse duty type of homopolar generator.

The invention is a new and improved composite brush to shunt attachment and a method for interfacing current collection systems which obtains a diffusion bond between a metal composite brush and a conductive shunt. The shunt is substantially a pure metal form of that used in the composite brush, and the method includes the steps of isolating, evacuating, and sealing the interfacial region to be bonded and then subjecting it to high pressure and temperature simultaneously, followed by a controlled cooling cycle, in order to provide a metal diffusion bond with substantially reduced electrical resistivity. The enhanced electrical and mechanical characteristics of the brush to shunt interface is fundamental to meeting continuous operational duty, lifetime requirements of high current density motors and generators.

The new and improved composite brush to shunt attachment and method for interfacing are described by illustrating only those parts of a generator and motor system pertinent to the understanding of the invention, and supplemental portions of the rotating machine system have been incorporated by reference to a U.S. patent which has been assigned to the same assignee as the present application.

Accordingly, U.S. Pat. No. 4,710,665 describes a homopolar dynamoelectric machine which is designed for operation at very high energy levels, exemplary of which is 10 Megajoule (2.8 kilowatt-hours) and total current collection capabilities of 1.5 million amperes. This corresponds to current densities of between 10 and 15 kiloamps per square inch or roughly 500 amperes for each current collecting brush provided that there are roughly 7200 brushes in a machine with this capacity. A pulse duty cycle for current generation occurs in approximately 100 milliseconds, while the rotor is spinning on its axis at nearly 14,000 revolutions per minute (rpm). The terminal output voltage is at a nominal and unspectacular value of around 50 volts for this D.C. generating machine which produces gargantuan pulse currents of the above referred magnitude.

Figure 4:
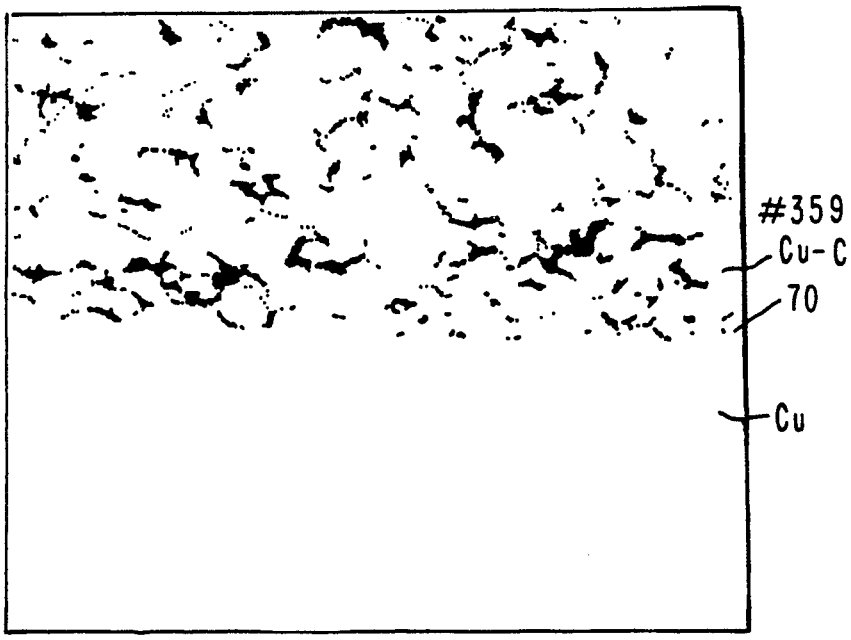
FIG. 4 is a tracing of a photomicrograph for the interface between #359 composite copper-graphite material after bonding to a copper conductive shunt material, with no evidence of interfacial anomalies.

Referring now to FIG. 1, which was previously presented as FIG. 4 in the above incorporated by reference U.S. Patent, it shows an isometric view of a box type of brush assembly 10 used in a homopolar machine which is capable of generating the profile of parameters mentioned above. The D.C. machine which used this type of brush box assembly 10 is functionally suited to the task of collecting and delivering short, high current pulses to a storage inductor and a final load consisting of a resistance-inductive system. This is accomplished by drawing the current from the surface of a rapidly rotating rotor (not shown) through each of a plurality of the brush box assemblies 10 which are organized to symmetrically surround the rotor surface.

The individual brush box assembly 10 is constructed with a metallic housing 12 in which resides an array of spring finger contact shunts 16 which constitute a plurality capable of receiving a plurality of brushes 14. The brushes in a plural brush array 14 assembled in plural stacking transport brush holders 20 which are shown withdrawn above the brush box housing 12. A plurality of actuating assembly units 22 are respectively engaged with the stacking transport brush holders 20, and this provides the lifting and lowering mechanism for the brushes 14. Usually the units 22 are pneumatically operated with all the brush actuators being connected in parallel in order to provide for simultaneously raising and lowering. All the brushes 14 are thereby forced into rubbing contact with the rotor surface with equal pressure and response time.

Elastomeric rings 24 are provided to resiliently cushion each individual brush 14 as it is projected into its normal operating position. Conductive engagement is made with each of respective opposing pairs of spring finger shunts 16 positioned to engage the individual brushes 14 which pass through in a short stroke or cyclic oscillation. The bottom surface of each brush 14 comes into a sliding or a rubbing contact on the surface of the rotor, with each individual brush box housing 12 being mounted to straddle a pair of conductive mounting rings (not shown). The mounting engagement is fixed for the brush box housing with a mounting arm pair 26, 28 in order to establish a structural proximity to the rotor surface. This metallic structure also establishes a current path through the mounting arms 26, 28 through the conductive mounting rings to the final load circuit (also not shown) which has been mentioned as resistive-inductive for the system. The circuit established with sliding electrical brush 14 to rotor contact in the current collection zone of the rotor is connected to one end of a generally cylindrical stator conductor (likewise not shown). The brush boxes 12 are spaced equally around the periphery at intervals of an exemplary angle of 9° or less and may constitute in excess of 40 brush boxes per side of the machine. This is in order to minimize the brush current density for a given total output current of the previously mentioned 1.5 million amperes.

Notwithstanding the above measures to minimize or reduce the individual brush current values in the range of 500 to 1000 amperes per brush for pulse duty type operation, a relatively high resistance bottleneck has heretofore existed in the transfer interface zone for each of the individual spring finger contact shunts 16. Transferring the current from the individual brushes 14 to which the spring fingers form conductive contact is the path through which the current from the brush box housing 12 is transferred to the load circuit, as previously mentioned. The spring finger contact shunts 16 are typically manufactured from Beryllium Copper and are then plated with silver in order to minimize the resistivity and maximize the conductivity at each interface with the individual current collecting brushes 14 in the system. Despite these precautions, the spring finger contacts 16 are susceptible to burn out, but they are sometimes relegated to moderate or short term usage, such as 5 to 15 second lifetime operating durations. Thermal constraints imposed in the brush to shunt attachment or manufacture makes the spring finger contact a remote contender for homopolar continuous duty operation environment since this is a weak form because of high resistivity in brush to shunt attachment. The relatively high resistivity in the interface contributes to a high temperature rise in the brush, and this severely limits the performance of the brush. It is regarded as a less than adequate way to meet the demands imposed by continuous duty, high power homopolar generator or power supply.

Figure 2:
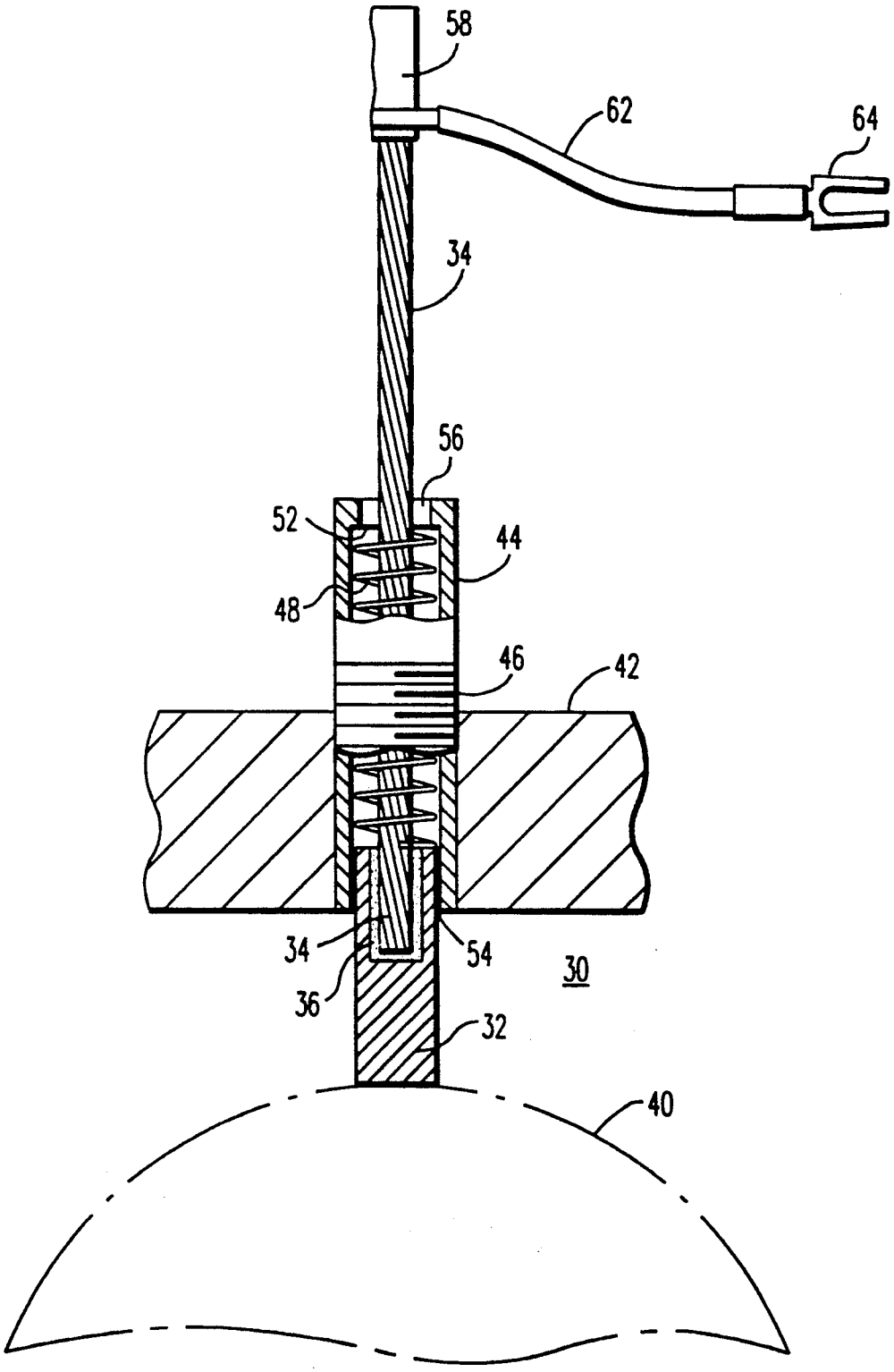
FIG. 2 PRIOR ART
FIG. 2 is a prior art showing in elevational view of a current collecting cylindrical brush assembly, with a spring loaded insulator collar through which the shunt with brush interface retracts when the brush is actuated into engagement with the rotor of a dynamoelectric machine.

The present state of the art technology for typical brush to shunt attachments also utilizes tamped shunts for which an example will be shown in the subsequent description relating to FIG. 2. Before proceeding to this prior art discussion, it may be well to consider that some remaining shunt attachments are known according to the present technology. These include the presently unusable, but structurally preferred, welding and brazing techniques which are unacceptable because of the temperature affects on the composite metal brushes. These brushes 14 are typically formed from a powdered metal composite of copper or silver metal and taken with the addition of graphite and other volatile components. These volatile components, experience with brazing or welding interfacial processes has shown, are volatilized and prevent the formation of a brush to shunt bond.

Soldering is a more acceptable alternative from the standpoint of temperature reduction in the brush to shunt attachment zone, but the joint formed is not capable of withstanding the stress imposed on it in a homopolar machine. This is because it subjects the brushes to a transitional positioning which may occur a limited number of times, but the effect of the joint deterioration can occur in any number of transitions. Any stress fracture is unacceptable because it would immediately limit the performance of the brush at the high current densities involved. The impact this would have would be damaging in the homopolar power supplies for the fields of use intended. These include application in the Strategic Defense Initiative (SDI) and also in high power radar, and in power welding applications. These concerns further removes the availability of soldering techniques from likely contention, since dependability of the product is a prerequisite in any and all of these disciplines.

Another discredited technique for brush to shunt attachment is that of riveting for the interface between a composite brush and non-composite conductive shunt. The surface area in contact for the joint materials is characteristically not sufficiently flat enough to avoid the problem of localized area of extreme heat being generated at the large values of current through the joint. This joint formed with the metal at the rivet tends to anneal and physically degrade and deform the joint under the operating parameters, as mentioned above for the respective homopolar generators and their progeny.

Now referring to FIG. 2 which shows a motoring brush assembly 30 which serves an example of a tamped brush to shunt attachment, as used in a homopolar design designed for Elgin AFB. The motoring brush assembly 30 is relevant for these purposes, although a more detailed understanding of the homopolar machine for which it has been useful is described in U.S. Pat. No. 4,710,666. Supplemental portions of the system are incorporated by reference from this patent which has been assigned to the same assignee as the present invention. The homopolar machine for which the motoring brush assembly 30 was designed to provide an electrode power of 50 to 100 horsepower. A complement of sixteen similar brush assemblies 30 are located at each end of a rotor (not shown). The rotor contact surface is represented by a curvature 40 in the present FIG. 2 representing the zone near the surface of a cylindrical rotor shown as a dashed cord of a circle. The output power correspondingly is from about 37 kilowatts to 75 kilowatts, and the plurality of brushes at each end carry up to 7500 amperes with each brush carrying nearly 500 amperes individually.

The composition of each metal composite brush 32 shown in FIG. 2 is a silver and graphite composite with the silver being the predominant component by weight of from 90 to 93%, and the graphite which serves as a lubricant is mixed with other volatiles in composition to occupy the remainder of the 100% weight. A brush length of 1.25 to 1.5 inches (3.175 to 3.81 cm) is exemplary with a half of this length or more being available for the rubbing surface contact with the rotor curvature 40. Typically the brush wear does usually not exceed an amount greater than roughly 0.25 inches (0.635 cm) under normal operating operations.

A copper and graphite brush with the same relative weight of components has also been used for the brush 32, and a conductive shunt 34 was made of bundles of #40 gauge copper shunt wire which is extremely fine stranded copper wire. The conductive shunt 34 is inserted into a cylindrical hole drilled into the end of the brush 32 which is opposite to the rubbing end for the rotor curvature 40. The hole is drilled with a diameter large enough to loosely fit the conductive shunt 34 which extends nearly to the length of the hole. A tamping material 36 is introduced into the hole, and it is compacted around the shunt wires 34 in order to fill the hole to its upper level. The brush to shunt attachment 32, 34, 36 is then subjected to a moderate temperature which sinters the tamping material in the hole so that the shunt 34 is not free to leave the brush 32 interior under normal conditions. Normally, proprietary type mixes, i.e. resins formed with metallic compounds are used for the tamping material which is thought of as a semiconductor adhesive. This is regarded as a troublesome resistance joint in the assembly of the composite brush 32 and metallic shunt 34 which is the direct path for current flow in the motoring system.

The FIG. 2 arrangement also includes the mounting transport 42 for the brush assembly 30 which may be considered as a stationary rest for a brush support housing 44 having exterior housing threads 46 threaded into matching threads in the interior of the mounting transport 42. This is for the purpose of establishing a relatively fixed operating position for the brush 32 with respect to the rotor curvature 40. A preloading spring 48 is positioned inside the brush support housing 44 and is limited in motion at one end against an inside shoulder 52 of the housing 44. An open housing end 54 faces the brush 32 which has an exemplary cylindrical shape so that the brush may retract into the open housing end 54 increasing the pressure of the spring force which has a natural tendency to move the brush 32 onto the rotor curvature 40. This is so that the brush 32 may track a smooth surfaced rotor with the spring pressure force upon it.

The conductive shunt 34 is free to move in either direction towards the open housing end 54, and the shunt is attached at its remaining end to a spade lug 58 which is attachable to a bus (not shown) which is a conductive material such as copper to expedite the flow of current. An instrument lead 62 with a terminal clip 64 is attached to a voltage monitoring instrument (not shown) so that the brush voltage potential can be monitored. This brush to shunt attachment is primarily useful in taking the motor up to full operational speed for a machine initially at rest or otherwise from loitering speed which may be a reduced number of rpms. This motoring function is not intended to subject the brush to shunt attachment to heavy duty current pulsing as with the brush box described with respect to FIG. 1.

A more continuous operating mode is intended for the motoring brush assembly 30, so it should be fortified to withstand the lifetime cyclic conditions to which it must respond. Enhancements are needed to be directed to the interface of the tamped brush to shunt attachment which is considered to be the weakest link. It, therefore, is the most subject to improvement in order to widen the electrical and mechanical performance characteristics of the brush, in order to meet continuous operational duty, lifetime requirements. All things being relative, it is envisioned that even a lifetime requirement of 25 to 30 minutes of continuous operation should be flawlessly accomplished without mechanical or electrical breakdown in the critical joint 36. This tamped joint is considered to be semiconductive, and therefore, this predicts that it is not the most adequate arrangement suitable for the intended purposes.

The realization of a widened applicability for homopolar propulsion motors is the driving force for this invention which is intended to obviate the above alluded to problems which apply to spring finger contact shunts as described with respect to FIG. 1 and the tamped shunt configuration as described with respect to FIG. 2. Soldering a joint between brush and shunt has not proven successful, especially with regard to mechanical resiliency to avoid stress fractures or pits in the interfacial zone. Welding or brazing of copper shunts to a composite carbon copper brush has proven unsuccessful because the volatile graphite products are driven off under the application of heat to required temperatures so as to preclude the wetting or capillary type of attraction that would serve to fill the voids in the joint.

The problem is that material limits establish how hot the temperature can be for the volatile products not to be driven to contaminate the interfacial joint during the process of bonding. It is also understood that the interfacial lower melting temperature layer which is next to the melted interface, during conventional brazing or soldering, is oftentimes subject to a tensile state of stress. The joint clad is typically an area of void and crack initiation. This promotes delamination at the joint during high density current service conditions which demands a high continuous duty. The resultant joint is like the one for the tamping approach which results in a higher resistivity interface and a higher temperature rise in the brush which in turn limits the performance of the machine.

The need is to circumvent the temperature limitations imposed by the brush to shunt attachment which are observed to be more limiting than the basic temperature limitations as seen from the current collection frictionally rubbing with the rotor of the machine. The present invention broadly is directed to a method which obtains a good metallurgical bond between composite brush and shunt conductors, without changing the composition of the brush material and without volatilizing the graphite and other additives which are inherently present for other functional purpose such as lubrication. The powdered metal composite brushmaking process already produces acceptable brushes for high current density current zone collection.

The method of the present invention is for metallurgically bonding a brush to a conductive shunt through hot isostatic pressing (HIP) which consists of applying high pressure and temperature simultaneously at the brush to shunt attachment interface. Although recognition of hot isostatic pressure (HIP) bonding process has been previously seen to be ". . . a bonding process which is performed under extreme pressures (circa 18,000 p.s.i.a.) and at elevated temperatures (circa 2200° F.)." which is 1204° C., for joining ". . . two dissimilar materials and thereby maintaining the structural integrity of the materials." it was not previously thought to ". . . permit optimizing the heat treatment of structural parts for maximum strength." Such a recognition was provided by avoiding the joining of ferromagnetic and nonmagnetic rotor material as described in U.S. Pat. No. 4,336,649 which relies on an insertion technique for holding magnets in place between support members which are wedge-shaped. A similar recognition was given in U.S. Pat. No. 4,339,874 which again avoids the use of HIP process and relies on wedge-shaped permanent magnets in a configuration with converging support members.

Figure 3:
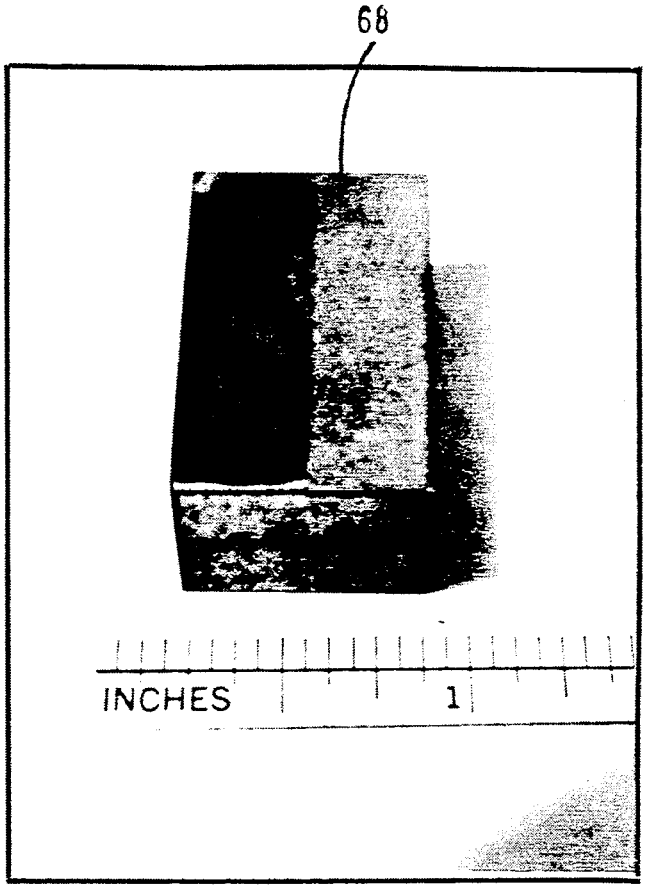
FIG. 3 is a non-screen reproduction of a photograph of a sample of non-composite copper block HIP diffusion bonded according to the invention, with a copper-graphite composite block of material for brushes.

The method of the present invention for fabricating a composite brush to shunt attachment is distinguished on its merits in arriving at an improved melded or diffusion bonded brush to shunt attachment. The resultant material is shown in FIG. 3 of which is a non-screen reproduction of a photograph of a sample joint block of material interfacing between a #933 composite copper-graphite half block bonded to a copper half-block of material, which is roughly to the scale as shown by the photographic image of a measuring stick in inches.

The method steps of this invention are used to isolate, evacuate, and seal the brush to shunt interfacial area, and it includes the following two approaches. The first approach is to weld seal the brush to shunt interfacel edge using an electron beam welder.

The second method includes canning or placing the entire assemblage of brush to shunt material for the workpiece inside a metallic membrane which serves as a thin member or envelope or box that is tightly fitted around the total workpiece material. The can or metallic membrane box is made from metals such as stainless steel or molybdenum, and the can or box is fitted with an evacuation tube in order to remove the atmosphere. A separating medium such as graphite is initially applied to the workpiece in order to insure separation of the conductive shunt and composite brush material from the metallic membrane after the hot isostatic pressing is completed. The can or metallic membrane box is outgassed so that all gasses are removed and then it is sealed.

In either of the first or the second method, the sealed can, or the metallic membrane containing the interface of the workpiece in the first method and the entire workpiece in the second method, is then placed in a hot isostatic press (HIP) which is the equivalent of a pressurized oven. Taking the temperature up to a controlled value in the range of 648° C. to 1083° C. (1200° F. to 1985° F.) is done with a simultaneous pressure in the oven being maintained in the range of 10,000 psi to 30,000 psi (1786 to 5358 kg/cm$^2$). This is followed by a thermal cooling cycle of approximately 100° C. per hour, and upon completion of the steps of this HIP cycle, the can or metallic membrane is withdrawn from the pressurized oven or vessel. The can is cut open and the workpiece removed therefrom. Following the second method described above has resulted in the diffusion bond 68 mentioned in the reproduction of a photograph previously referred to as FIG. 3.

FIG. 4 is a tracing of a photomicrograph for the interface between Brush Grade #359 composite copper carbon and graphite material after bonding to a copper conductive shunt material, and this shows no evidence of interfacial anomalies. The interface 70 is crack free and porosity free approaching to an extent very nearly that of 100% of actual area being in contact at the joint.

The material used for both the brush grades #359 and #933, each of, which are copper carbon, was obtained from Stackpole, Inc. which does business in St. Mary's, Pa. Trade secrets may protect the composition of the volatile binders that are used in the brush mixture with copper which is about 90-93% by weight. The remainder is graphite which is also volatile under certain temperature conditions as previously discussed. The HIP process should not be taken to a temperature higher than the temperature that was originally used in manufacturing the brush which will be referred to as the sintering temperature.

Figure 5:
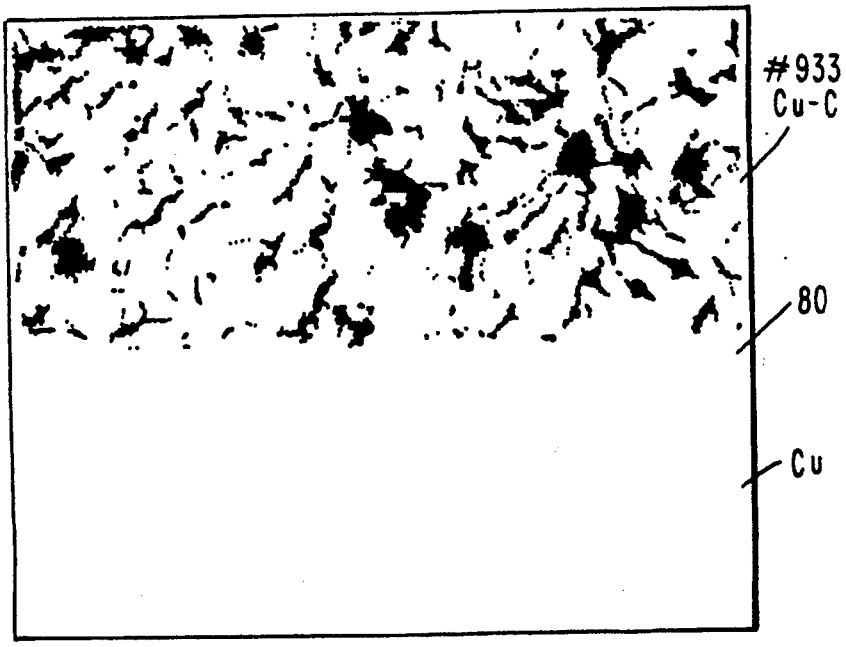
FIG. 5 is a tracing of a photomicrograph of the interface between #933 composite copper-graphite material after bonding to a copper conductive shunt material with no evidence of interfacial anomalies.

FIG. 5 is a tracing of a photomicrograph for the interface between #933 composite copper graphite material after bonding to a copper conductive shunt material, also with no evidence of interfacial anomalies. There is no line of demarcation 80 where the two materials have diffused and intermingled at the joint. The material of FIG. 3, as represented by the tracing of the photomicrograph in FIG. 5, is representative of the copper-carbon and copper interfacial bond according to the present invention. The invention includes a method of fabricating a composite brush to shunt attachment. The next direction of the disclosure is how this approach provides a brush to shunt attachment with the same usable area of the brush and still has the capability of using standard metallurgical means of attaching the shunt to the brush. A transition piece will be shown as part of the fabrication made with pure copper or pure silver portions at an interfacial bond, as will be seen more clearly with respect to the next discussion.

Figure 6:
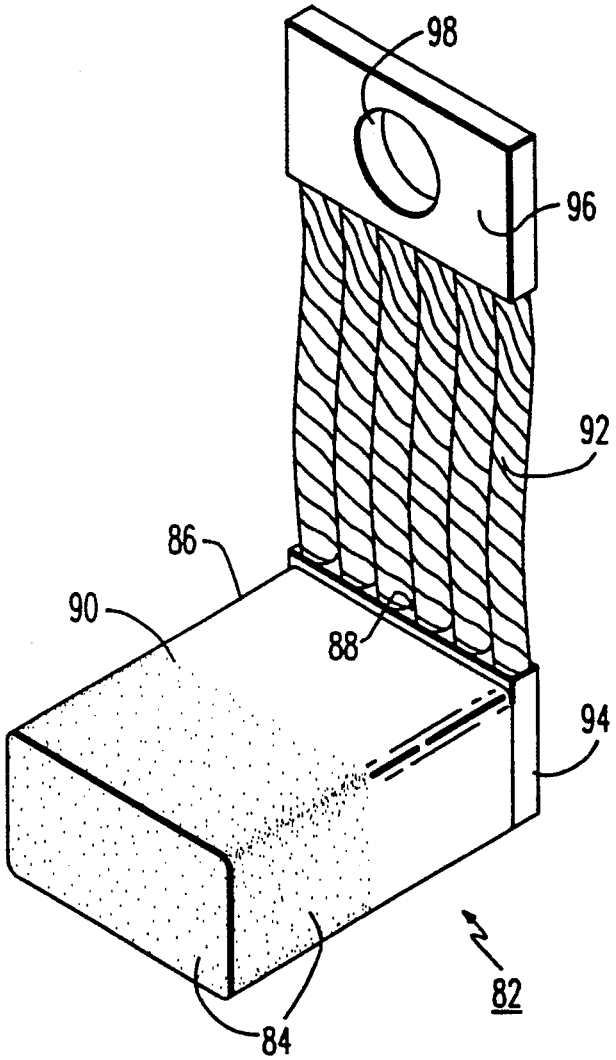
FIG. 6 is an isometric view of a composite brush to shunt attachment, according to the invention, showing a non-composite shunt that has been HIP bonded to a copper-graphite brush (foremost portion) to provide a welding or brazing platform for an extending braided shunt lead which is securely attached.

FIG. 6 is an isometric view of a composite brush to shunt attachment, according to the invention, which shows a continuous duty brush 82. The brush 82 may used for a propulsion motor with continuous duty current collection in a most favorable manner. Such a propulsion motor is one sought after in an electrical ship's drive. Another important use for some would be in a tracked vehicle such as a bulldozer or a battle tank for all terrain use. Another more recognizable and frequent use would be as that of a starter motor brush to shunt attachment which could be used for a variety of vehicle types in order to obviate the fear that starter failure will occur at a most unsuspecting moment when the vehicle cannot be coaxed to start under its own power.

In the embodiment of FIG. 6 the continuous duty brush to shunt attachment 82 includes a composite metallic brush 84, which is shown stipled, to illustrate a composite copper graphite brush portion. The brush 84 is diffusion bonded to a transition piece conductor 86 according to applicants' method, which may take place in a batch process for making dozens or even thousands of interfacial joints. The diffusion bond shown at 90 is with the transition piece 86 which is complementary made of a pure metal. This piece 86 occupies roughly 50% or less of the length of the continuous duty brush to shunt attachment 82. The transition piece 86 thus serves as a welding or brazing interface 88 for a braided belt conductive shunt 92 which is comprised of fine shunt wires. A welding interface land 94 and a mounting lug 98 at the other end are provided for conductive connection to a copper bus (not shown). Connection is made through a mounting aperture or hole 98 for receiving a bolt (not shown) for a stable conductive transfer to occur from the composite brush to the bus.

The welding or brazing interface 88 lays between the welding interface land 94 which may be made of copper and the copper transition piece 86. Electron beam welding is provided to take place where it works well, i.e. on pure materials such as this, since otherwise it would give an explosive type reaction if the joint were located where a material with a percentage of carbon were instead located at the brush to shunt attachment joint without using the transition piece 86. The welding or brazing interface 88 is located sufficiently distant from the interfacial diffusion bond 90 so that temperatures are never elevated in the diffusion bond 90 so as to preserve the volatile components of the composite metallic brush 84.

Some of the advantages to the present inventive method are that a sound metallurgical joint 90 is formed which provides good mechanical strength, good electrical conductivity as well as good thermal conductivity. This fabrication of the interfacial bond 90 and the welding or brazing interface 88 being physically displaced therefrom permits directed energy beam joining of the conductive shunt. Both laser and electron beam welds can be easily accomplished at the interface 88 without the risk of temperature destruction of the formulated composite metal and graphite brush. No additional reinforcement of the joint is necessary, while previously the soldered joints were failing at the joint. A scant few pounds of stressing force applied to the prior art joints would mean the joint could not be relied upon even with these low stress levels. It is postulated that the diffusion bond or joint interface 90 is in a compressive state of stress which is a condition conducive to non-initiation of cracks at the interface even during continuous duty service in a rotating machine current collection system.

The interfacial bond 90 is devoid of ternary or contaminating materials which thus eliminates a high resistance interface. The interface, moreover is crack free and porosity free within the inter-diffusion zone of the interface leading to higher interfacial strengths and thus eliminating the need for plated interfaces. The thermal rise characteristics of the clad in the joint are likewise improved, and an ultrasonic scan of the interface of the materials represented has revealed that an excellent, void free interface was obtained. This is a characteristic of an excellent metallurgical bond having been obtained.

An ultrasonic analysis of the conductive attachment piece 86 and the copper graphite 84 at the joint formed shows that there is no porosity present at the bond interface and that the bond was obtained without loss of the volatiles. This demonstrates that a composite brush to shunt fabricated attachment has been accorded to this invention that significantly improves the performance of the brush above the state of the art.

We claim:

1. A method of fabricating a composite brush to shut attachment, comprising:

providing a brush consisting of a metal composite material having one or more volatile components, said volatile component, normally being volatile at the brush to shunt bonding temperature range;

providing a shunt of substantially non-composite metal; and bonding said metal composite brush to said shunt by a hot isostatic pressing (HIP) to provide substantially reduced electrical resistivity in the interface of the bonded brush to shunt attachment, thereby enhancing the electrical and mechanical performance characteristics of the brush to meet continuous operational duty, lifetime requirements.

2. The method of fabricating a composite brush to shunt attachment of claim 1, wherein the metal composite brush material is a copper-graphite composite and the non-composite brush material is copper.

3. The method of fabricating a composite brush to shunt attachment of claim 1, wherein the metal composite brush material is a silver-graphite composite and the non-composite brush material is silver.

4. The method of fabricating a brush to shunt attachment of claim 1, wherein the hot isostatic pressing of the non-composite metal for bonding to said metal composite brush includes applying high pressure and temperature simultaneously at the brush to shunt interface.

5. The method of fabricating a brush to shunt attachment of claim 4, wherein the hot isostatic pressing of the non-composite metal for bonding to said metal composite brush includes isolating or canning the brush to shunt interface in a metal envelope or casing for controlling the environment, evacuating or outgassing the air adjacent to the interface, and sealing the interfacial area before applying the high pressure and temperature in the process.

6. The method of fabricating the brush to shunt attachment of claim 5, including applying a separating medium within the metal envelope to ensure separation of the metal envelope or casing for the duration of the hot isostatic pressing and cooling time period.

7. The method of fabricating the brush to shunt attachment of claim 1, wherein the range of high temperatures used in the hot isostatic pressing is between 800 to 1083 degrees Centigrade.

8. The method of fabricating the brush to shunt attachment of claim 1, wherein the range of high pressures used in the hot isostatic pressing is included between 10,000 and 30,000 pounds per square inch.

9. The method of fabricating the brush to shunt attachment of claim 1, wherein a thermal cooling cycle is initiated after the hot isostatic pressing of the brush to shunt attachment occurs, and said cooling temperature decline being in the range of 100 degrees Centigrade per hour.

10. The method of fabricating the brush to shunt attachment of claim 1, wherein a batch of interfacial shunt to brush attachments occur within a common pressure vessel which is designed to accommodate a plurality of brush to shunt attachments which may range into the thousands.

11. A method of making a current transfer apparatus for a dynamoelectric machine, said current transfer apparatus making electrical contact through a current collecting zone on the surface of a rotating rotor, said method comprising:

providing a composite brush to shunt attachment including a brush consisting of a metal composite material having one or more volatile components normally being adversely affected by the brush to shunt bonding temperature; and hot isostatic pressing (HIP) a transition element of substantially non-composite metal to bond said shunt to said metal composite brush by the hot isostatic pressing to provide a substantially reduced electrical resistivity in the interface of the bonded brush to shunt attachment, in order to enhance the electrical and mechanical performance characteristics of the brush to meet continuous operational duty, lifetime requirements.

* * * * *